US005941028A

United States Patent [19]

Hicks

[11] Patent Number: 5,941,028

[45] **Date of Patent: *Aug. 24, 1999**

[54] ROOF EDGE VENTILATION STRIP

[76] Inventor: Robert M. Hicks, 124 Main St, Westford, Mass. 01886

[ * ] Notice: This patent issued on a continued prosecution application filed under 37 CFR 1.53(d), and is subject to the twenty year patent term provisions of 35 U.S.C. 154(a)(2).

[21] Appl. No.: 08/621,147

[22] Filed: Mar. 21, 1996

[51] Int. Cl.[6] ..... E04D 13/17

[52] U.S. Cl. ..... 52/95; 52/94; 52/473; 454/260; 454/365

[58] Field of Search ..... 52/94, 95, 198, 52/199, 473, 720.1; 454/260, 277, 365, 366, 276, 280

[56] References Cited

U.S. PATENT DOCUMENTS

| | | | |
|---|---|---|---|
| D. 271,713 | 12/1983 | Hicks . | |
| 936,322 | 10/1909 | Jeffers . | |
| 1,791,639 | 2/1931 | Robinson . | |
| 2,968,128 | 1/1961 | Pelican . | |
| 3,073,235 | 1/1963 | Smith et al. . | |
| 4,271,643 | 6/1981 | Sweers . | |
| 4,347,691 | 9/1982 | Loyd-Jones . | |
| 4,660,463 | 4/1987 | Bottomore et al. | 454/260 |
| 4,780,995 | 11/1988 | Gittins . | |
| 5,022,314 | 6/1991 | Waggoner . | |
| 5,328,406 | 7/1994 | Morris, Jr. et al. . | |
| 5,361,551 | 11/1994 | Post . | |

*Primary Examiner*—Carl D. Friedman
*Assistant Examiner*—Timothy B. Kang
*Attorney, Agent, or Firm*—Pearson & Pearson

[57] ABSTRACT

An improved roof edge ventilation strip serving as a starter strip to underlay the first course of shingling along a roof line. The roof edge ventilation strip comprises a roofing panel which is, in use, at substantially the same angle to the vertical as the roof to which it is attached. The material of the ventilation strip is wavy or corrugated for providing added strength. A horizontal soffit section of the ventilation strip has louvers which add strength to the ventilation strip and permit a ladder to be leaned against the strip outer edge. A vertical fascia section provides for fastening the ventilation strip in abutment to a vertical side of a house or a building. An alternate embodiment comprises a protruding drip edge to insure water run-off away from the house.

20 Claims, 4 Drawing Sheets

ROOF EDGE VENTILATION STRIP

BACKGROUND OF THE INVENTION

1. Field of the Invention

This patent relates generally to a starter strip for the lower edge of a roof and in particular to a roof edge ventilating strip.

2. Description of Related Art

U.S. Pat. No. 3,073,235 discloses roof ventilators for the ridge of a roof having a louvered surface which is sheltered from weather. It also discloses eave ventilators along the outer edges of the roof (FIGS. 4 and 5). A top portion of the eave ventilator is placed on top of sheathing and the top portion extends to an outer side wall portion which projects downwardly for a distance and then turns toward the side of the building forming a panel portion which has a flange 89 extending downward along the inner surface of the fascia board. The panel portion has louvers for providing air flow and outward deflection of driving rain and snow. The roof and eave ventilators are made from sheet metal, fiberglass, plastic or on other suitable, formable or moldable material. However, this ventilator has an outer sidewall which results in increased material costs and fabrication costs.

U.S. Pat. No. 4,347,691 describes a one piece soffit and fascia panel made of coated sheet metal for a building comprising a substantially level soffit section of uniform width extending forwardly of the wall structure at right angles thereto with an integral downturned flange carried by the inner end of the soffit section adapted to abut and be secured to the wall structure. The outer edge of the soffit section is bent down and then up a short distance later forming a channel having a fairly high vertical front flange which constitutes a fascia section. Ventilation apertures are formed in the soffit section by a series of parallel transverse cuts near to the rear side of this section and deforming the metal between the cuts to louvered ventilation openings. However, this panel does not provide a roof edge function and requires a narrow rectangular channel in the soffit section immediately adjacent to the fascia section.

U.S. Pat. No. Des. 271,713, discloses a combined starter vent and water shedding ventilation strip including a flat roofing panel, a louvered, horizontal soffit section and a short vertical bottom tab, fascia section. It further shows the louvered section being perpendicular to the fascia section and the top roofing panel meeting the louvered horizontal section at an angle in accordance with the pitch of a roof. However, this ventilation strip does not provide sufficient strength to support a ladder leaned against its edge without causing damage such as when various house maintenance tasks are performed.

Another U.S. design patent application Ser. No. 29/037,428, filed Apr. 12, 1995, now U.S. Pat. No. D372,969 discloses an improved combined starter vent and water shedding ventilation strip. This ventilation strip shows a fascia section having a channel extending below a soffit section for collecting moisture or condensation and preventing such moisture from getting to the fascia area of a building. The fascia section that abuts a side of the building, has a rippled structure. The roof section or panel shows a ripple section in the middle of the panel and extending along the width of this panel. However, this ventilation strip does not comprise waves or corrugation in all three sections making up the strip to produce added strength and it has a more complicated fascia section which increases costs.

SUMMARY

Accordingly, it is therefore an object of this invention to provide a stronger roof edge ventilation strip for the first course of shingling along the roof line of a roof.

It is a further object of this invention to allow roof edge air to circulate freely throughout attic areas and eaves when used with gable or ridge venting.

It is another object of this invention to provide one piece construction for an elongated roof edge and ventilation strip to reduce material and installation costs.

It is a further object of this invention to provide a roof edge ventilation strip having increased strength when installed for supporting a ladder leaned against its outer edge.

It is another object of this invention to provide a roof edge ventilation strip having a protruding lower edge to facilitate water run-off away from said strip.

These and other objects are accomplished by an integral ventilation strip for attaching to a roof edge comprising a first section in angular relationship to the slope of the roof extending under a first course of shingles on the roof, the first section lower end forming the roof edge, a second section having ventilation openings to provide ventilation under the roof with a first end joined to the first section lower end and extending horizontally inward under the first section, a third section having an upper end joined perpendicular to an inner end of the second section and projecting downward for fastening to a side of a structure, and each of the first section, the second section and the third section comprises a plurality of corrugations or waves. The first section lower end comprises a folded under drip bend connecting to said second section to facilitate water run-off. The ventilation strip comprises aluminum, and the ventilation openings comprise louvers. The first section, the second section and the third section each comprises the plurality of corrugation or waves for added roof edge strength. The first section is nailed under the first course of shingles causing the first section to straighten to virtual flatness. The corrugations or waves are slightly concave between ridges on the outside surfaces of the ventilation strip.

The objects are further accomplished by a roof construction comprising (a) roof sheathing positioned on rafters, (b) a fascia board positioned under the lower edge of the roof, (c) an integral roof edge ventilation strip attached to the roof sheathing and the facia board, the ventilation strip comprises a first section in angular relationship to the slope of the roof extending under a first course of shingles on the roof, the first section lower end forming the roof edge, a second section having ventilation openings to provide ventilation under the roof with a first end joined to the first section lower end and extending horizontally inward under the first section, a third section having an upper end joined perpendicular to the inner end of the second section and projecting downward for fastening to a side of a structure, each of the first section, the second section and the third section comprises a plurality of corrugations or waves, and (d) courses of shingles attached to the roof sheathing, the first course of shingles positioned over a portion of the roof edge ventilation strip. The first section lower end comprises a folded under drip bend connecting to said second section to facilitate water run-off. The ventilation strip comprises aluminum, and the ventilation openings comprises louvers. The first section, the second section and the third section comprise a plurality of corrugations or waves for added roof edge strength. The first section is nailed under the first course of shingles causing the first section to straighten to virtual flatness. The corrugations or waves are slightly concave between ridges on the outside surfaces of the ventilation strip.

The objects are further accomplished by an integral ventilation strip for attaching to a roof edge comprising a first section in angular relationship to the slope of the roof extending under a first course of shingles on the roof, the first section lower end having a drip bend folding under approximately 180 degrees forming the roof edge, a second section having ventilation openings to provide ventilation under the roof with a first end joined to the folding under lower end drip bend of the first section and extending horizontally inward under the first section, a third section having an upper end joined perpendicular to an inner end of the second section and projecting downward for fastening to a side of a structure, and each of the first section, the second section and the third section comprises a plurality of corrugations or waves. The ventilation strip comprises aluminum, and the ventilation openings comprise louvers. Each of the first section, the second section and the third section comprises the plurality of corrugation or waves for added roof edge strength.

The objects are further accomplished by a method of providing ventilation to a roof with an integral roof edge ventilation strip comprising the steps of extending under a first course of shingles on the roof, a first section of the ventilation strip in angular relationship to the slope of the roof, the first section lower end forming the roof edge, providing the ventilation under the roof with a second section of the ventilation strip having openings for air passage, with a first end joined to the first section lower end and extending horizontally inward under the first section toward a side of a structure, providing a third section of the ventilation strip having an upper end joined perpendicular to the inner end of the second section and projecting downward for fastening to the vertical side of the structure, and providing in the material for each of the first section, the second section and the third section a plurality of corrugations or waves for added roof edge strength. The step of providing the first section comprises the step of including a folded under drip bend at the lower end of the first section which connects to the section. The ventilation strip comprises the step of providing aluminum for the strip material. The step of providing openings for air passage in the second section comprises the step of providing louvers. The step of extending the first section under a first course of shingles comprises the step of nailing the shingles over the first section causing the first section to straighten to virtual flatness.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENTS

Figure 1:
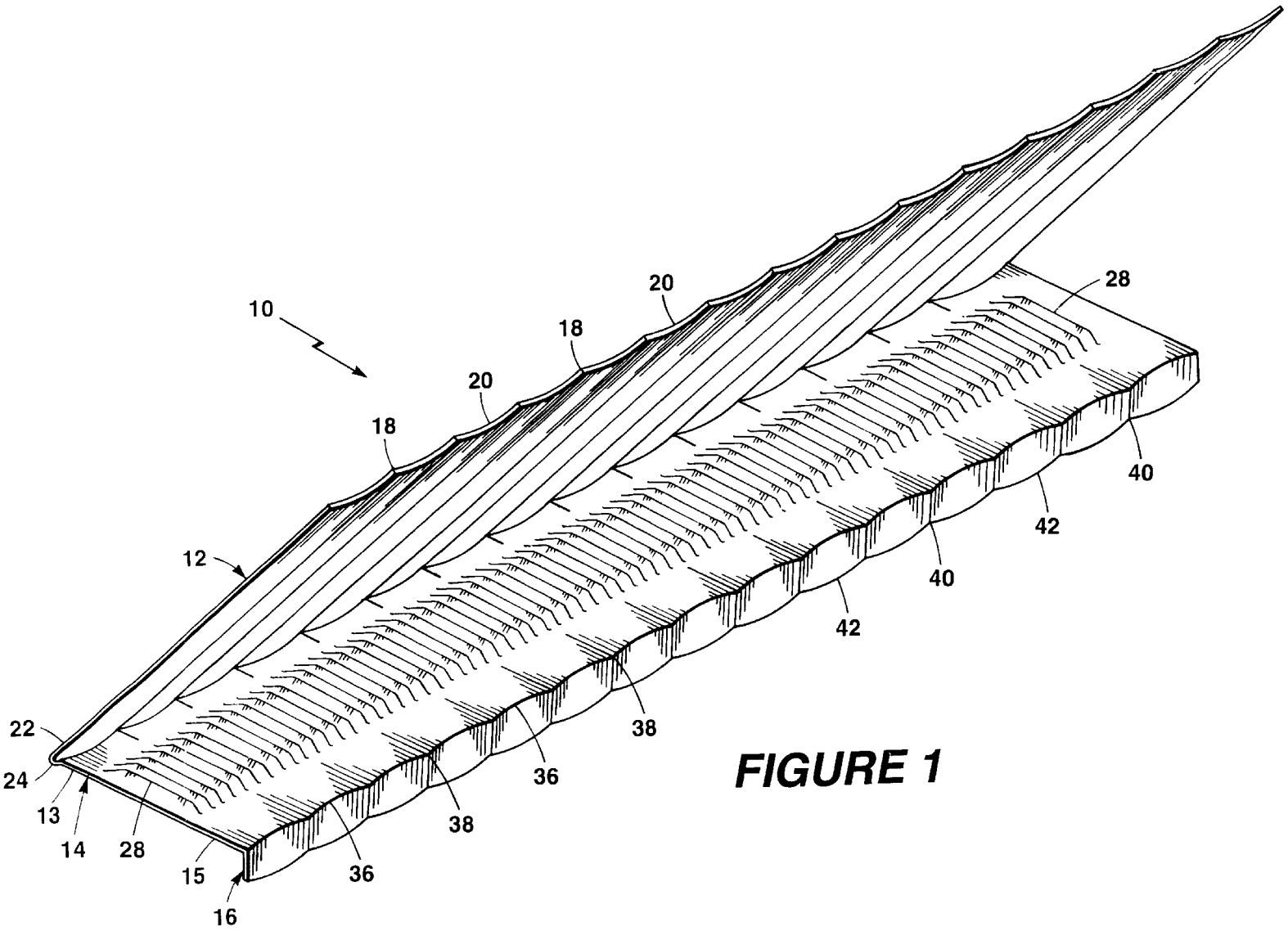
FIG. 1 is a perspective view of the invention of an improved roof edge ventilation strip taken from the rear and right end.

Referring to FIG. 1 a perspective view is shown of the invention of an improved roof edge ventilation strip 10. The integral ventilation strip 10 comprises a first section or upper panel 12, a second or horizontal section 14 having a first end 13 joined to a lower end 22 of the upper panel 12, and a third section 16 extending downward and perpendicular to a second end 15 of the horizontal section 14. The ventilation strip 10 serves as a starter strip to underlay a first course of shingling along a roof line.

Figure 2:
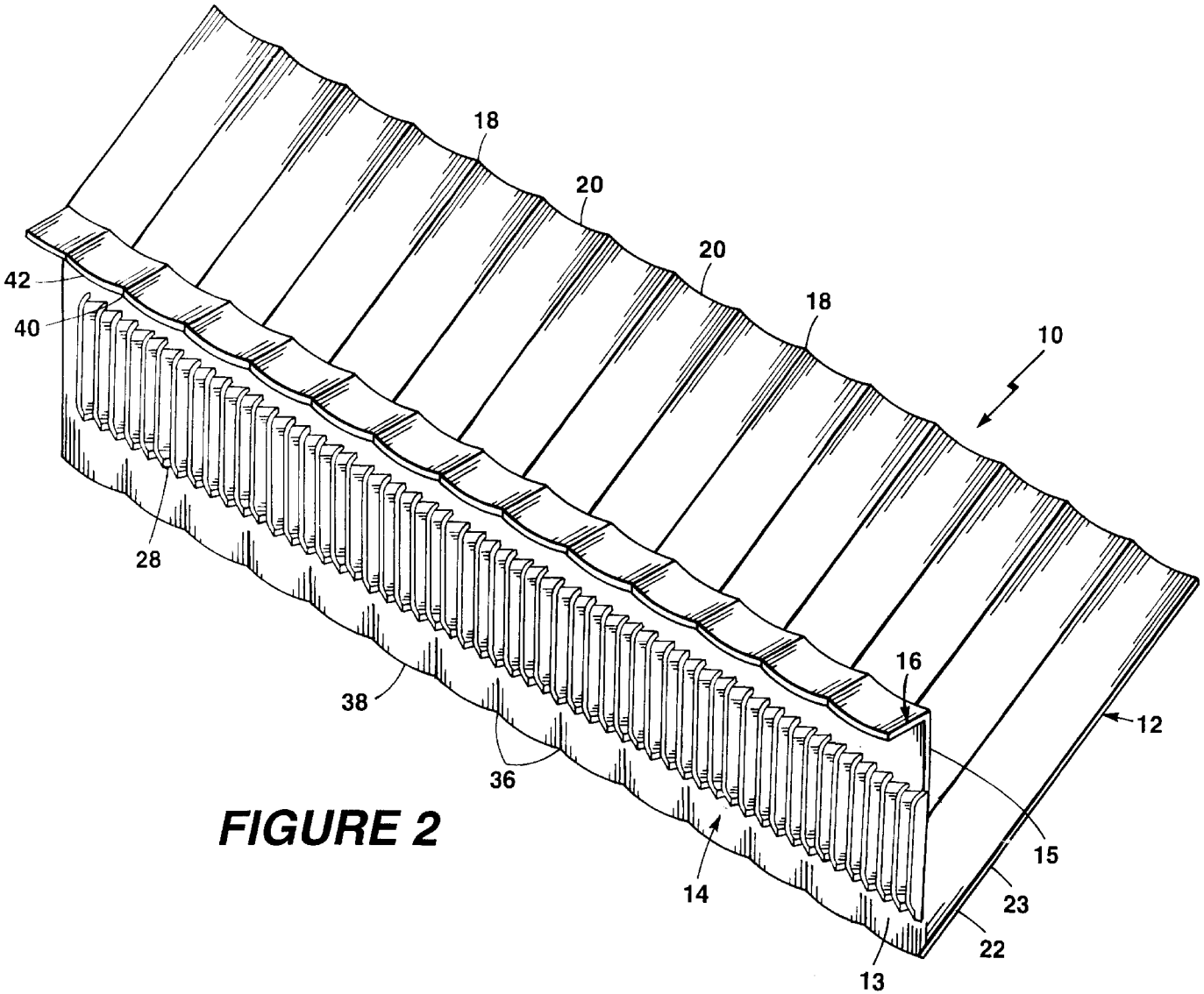
FIG. 2 is a perspective view of the invention of FIG. 1 taken from the bottom, rear and left end.
Figure 3:
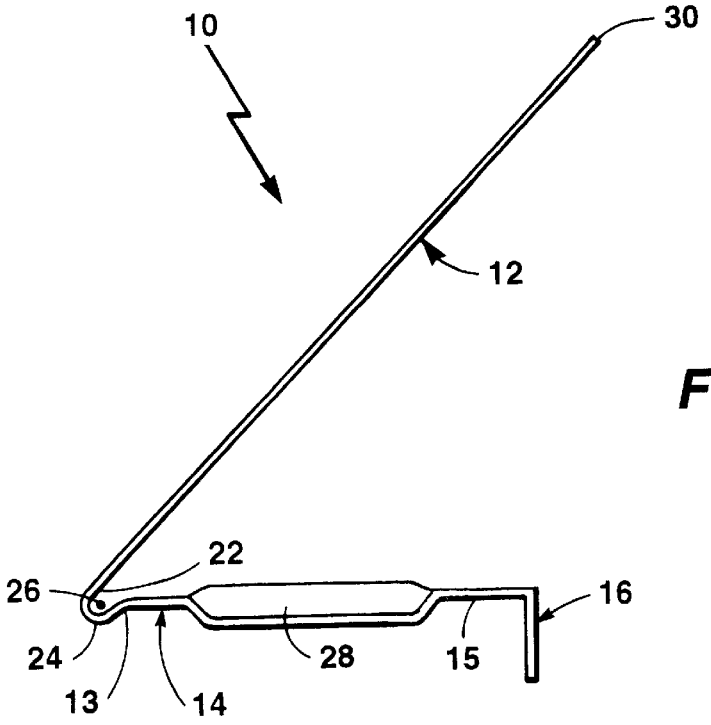
FIG. 3 is a right end elevational view of the invention of FIG. 1.

Referring now to FIG. 1, FIG. 2 and FIG. 3, the first section of upper panel 12 comprises a plurality of parallel ridges 18 with slightly concave depressions 20 (when viewed from the front) between each of the ridges 18 extending across the width of panel 12 forming a wavy or corrugated panel 12. Such a wavy or corrugated panel 12 provides added strength to the lower end 12 of the ventilation strip 10 to facilitate house or building maintenance such as being able to support a ladder leaned against the ventilation strip 10 without damage being incurred. The concave depressions 20 of the panel 12 slightly deviate from a 180 degree line by less than 5–10 degrees. Hence, the roofing ventilation strip 10, despite the slight corrugations, remains essentially flat, and when nailed in place becomes practically and substantially flat but having an added strength characteristic.

The second or horizontal section 14 extends from the lower end 22 of upper panel 12 by means of a downwardly turned drip bend 24 which is preferably in the form of a half cylinder externally convex having an axis 26 parallel to the lower end 22 of the upper panel 12. The folding under drip bend 24 extends slightly below the lowest adjacent first end 13 of the horizontal section 14.

The horizontal section 14 of the ventilation strip 10 comprises a plurality of louvers 28 as best seen in FIG. 2. The louvers 28 have lengths perpendicular to the edge of the roof to which it is attached. The louvers 28 are closely spaced adjacent to each other and extend preferably across the full width of the horizontal section 14. The horizontal or second section 14 extends substantially horizontal from its first end 13 to its second end 15. The second section 14 has ridges 36 and slight concave depressions 38 between the ridges 36 similar to the first section 12.

The third section 16 extends downward from the second end 15 of the horizontal section 14 a short distance sufficient to secure this third section 16 of the ventilation strip 19 to a facing or other surface of a building or structure. The third section has ridges 40 and slight concave depressions 42 between the ridges 40 similar to the first section 12 and second section 14.

Figure 4:
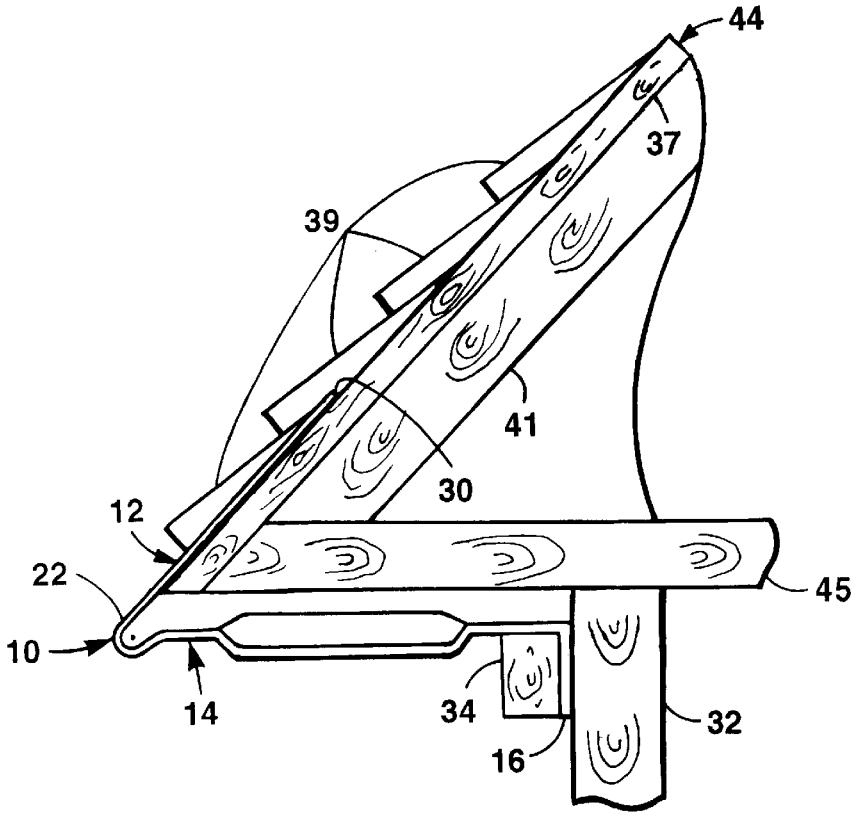
FIG. 4 is a cross section of an edge of a house roof in between rafters showing the improved roof edge ventilation strip attached to the roof sheathing and fascia board.

Referring now to FIG. 4, a cross section of an edge of a house roof 44 is shown. The integral roof edge ventilation strip 10 is applied to the lowermost edge of the roof 44 for which it is intended. The upper edge 30 of the upper panel 12 is placed under the line for a first course of shingles and rests on the roof sheathing 37 which is positioned on rafters 41. Horizontal beam 45 supports the rafter 41. The panel 12 is then nailed in place as flat as possible. The purpose of the corrugation or waves of the ventilation strip 10 is to provide an improved degree of stiffness to the ventilation strip 10 particularly at the drip bend 24 edge both before and after it is nailed in place. The degree of flatness of the panel 12 after it is nailed in place is such that the shingles to be nailed above it are not appreciably lifted from their normal position if at all. The additional courses of shingles are then nailed in place in the usual manner. The third section 16 is nailed to the vertical side or fascia board of the structure after the upper panel 12 is nailed in place. A one-half inch square molding board 34 or other appropriate size board is positioned against the third section 16 and nailed thereto providing proper attachment of the strip 10 to the house 32 or other structure. The third section 16 may be adjusted to its optimum position and in proper alignment both from the standpoint of integrity of the structure and for appearance.

Figure 5:
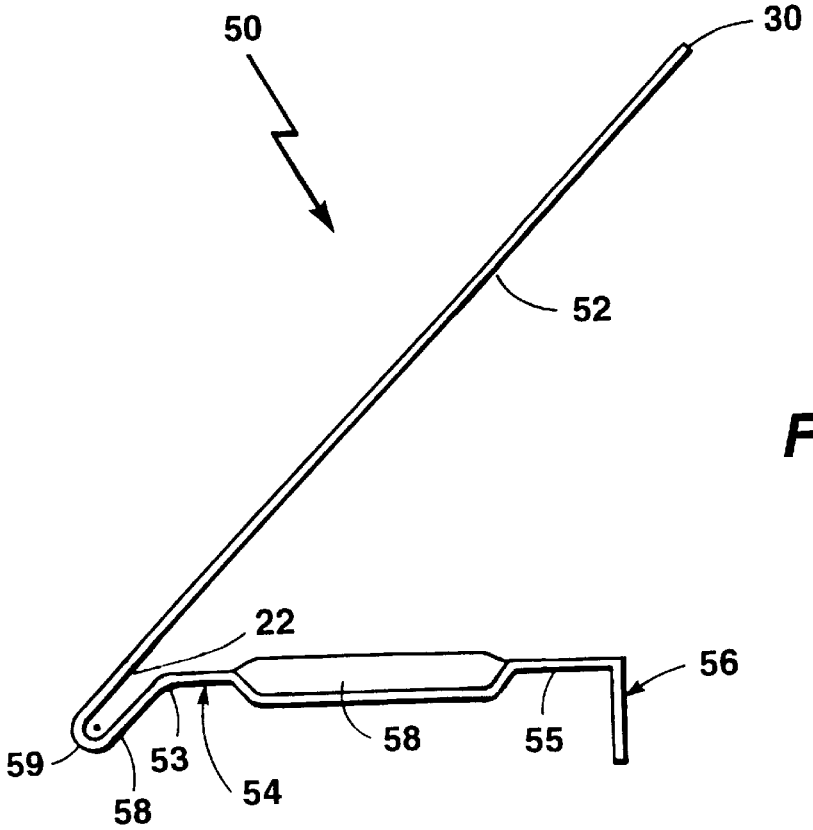
FIG. 5 is a right end elevational view of an alternate embodiment of the invention having a lower edge of a roof panel protruding below a horizontal louvered section.

Referring now to FIG. 5, an alternate embodiment of a roof edge ventilation strip 50 is shown. The integral ventilation strip 50 comprises a first section or upper panel 52, a second or horizontal section 54 having a first end 53 joined to an elongated or protruding folding under drip bend 58 of upper panel 52 folds under approximately 180 degrees and extends parallel to the upper panel 52 for a short distance to a horizontal position forming a third section 56, and then folds over to a horizontal position where a plurality of louvers 58 closely spaced across the width of the horizontal section 54 perpendicular to a roof edge line similar to the louvers 28 shown in FIG. 1 and FIG. 2. The inner end 55 of horizontal section 54 folds downward a short distance beyond the louvers 58 forming a third section 56. The third section 56 extends downward and perpendicular to a second end 55 of the horizontal section 54. The ventilation strip 50 is fabricated from a suitable material such as aluminum and each of the sections 52, 54, 56 comprises ridges and concave depressions forming a wavy or corrugated section for added strength similar to the embodiment shown in FIG. 1 and FIG. 2.

The embodiment shown in FIG. 5 comprising the protruding drip bend 58 insures that water running off the first section of the ventilation strip 50 falls to the ground and does not flow along the horizontal section 54 and down the side of a house.

In the preferred embodiment shown in FIGS. 1 through FIG. 4, the upper panel 12 is approximately 4 ½ inches in width. The horizontal section 14 is approximately 2 ¼ inches wide and the third section is approximately ¾ inch wide. The corrugation or waves in all three sections 12, 14, 16 of the ventilation strip 10 are approximately 7/16 inch from one ridge 20 to an adjacent ridge 20 as shown for the upper panel 12 in FIG. 1. The louvers 28 are approximately 1 ¼ inches long and the space between louvers is approximately ⅛ inch. The dimensions of the ventilation strip 10 may be varied as required by different building or structure application.

Referring now to FIG. 5, the dimensions of the alternate embodiment are similar to the dimensions for the strip 10 of FIG. 1 to FIG. 3 except for the elongated or protruding folded under drip bend 58 which measures approximately ¼ inch from the end 53 of the horizontal section 54 to the lowermost point 59 of the upper panel 52.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An integral ventilation strip of long and relatively narrow form comprising:

a first section in acute angular relationship to a second section, a lower end of said first section having a folded under drip bend in the form of a half cylinder externally convex having an axis parallel to said lower end of said first section, said drip bend continues into and joins with said second section of said ventilation strip, said drip bend extending below a first portion of said second section and capable of forming an edge of a roof;

said second section comprises a plurality of louvers to provide ventilation, said first portion of said second section being connected to and continuing away from said drip bend of said first section and continuing under said first section;

said second section continues into a third section having an upper end extending approximately perpendicular from an inner end of said second section and projecting in a direction away from said first section; and each of said first section, said second section and said third section comprises a plurality of corrugations or waves for increased strength.

2. The integral ventilation strip as recited in claim 1 wherein each ventilation strip comprises aluminum.

3. The ventilation strip as recited in claim 1 wherein said plurality of openings being arranged parallel to each other comprise louvers.

4. The integral ventilation strip as recited in claim 1 wherein said corrugations or waves are slightly concave between ridges on outside surfaces of said ventilation strip.

5. The integral ventilation strip as recited in claim 1 wherein said folded under drip bend folds under approximately 180 degrees.

6. A roof construction comprising:

(a) roof sheathing positioned on rafters;

(b) a fascia board attached under a lower edge of said roof construction;

(c) an integral roof edge ventilation strip attached to said roof sheathing and said fascia board, said ventilation strip comprises:

a first section in angular relationship to the slope of said roof construction extending under a first course of shingles on the roof, a lower end of said first section forming said lower edge of said roof construction;

said first section lower end comprises a folded under drip bend connecting to said second section to facilitate water run-off, said drip bend preferably in the form of a half-cylinder externally convex having an axis parallel to said first section lower end;

said second section having ventilation openings to provide ventilation under said roof construction with a first portion continuing from said first section which extends below said second section, and said second section connecting to said first section lower end at an acute angle and immediately extending horizontally inward under said first section lower end;

said second section continuing into a third section having an upper end extending approximately perpendicular from the inner end of said second section and projecting downward for fastening to a side of a structure supporting said roof construction;

each of said first section, said second section and said third section comprises a plurality of corrugations or waves for added roof edge strength; and (d) courses of shingles attached to said roof sheathing, said first course of shingles positioned over a portion of said roof edge ventilation strip.

7. The roof construction as recited in claim 6 wherein said ventilation strip comprises aluminum.

8. The roof construction as recited in claim 6 wherein said ventilation openings comprise louvers.

9. The roof construction as recited in claim 6 wherein said first section is nailed under said first course of shingles causing said first section to straighten to become substantially flat.

10. The roof construction as recited in claim 6 wherein said corrugations or waves are slightly concave between ridges on outside surfaces of said ventilation strip.

11. A roof construction comprising:

(a) roof sheathing positioned on rafters;

(b) a fascia board attached under a lower edge of said roof construction;

(c) an integral roof edge ventilation strip attached to said roof sheathing and said fascia board, said ventilation strip comprises:

a first section in angular relationship to the slope of said roof extending under a first course of shingles on the roof, a lower end of said first section having a drip bend folding under approximately 180 degrees forming said lower edge of said roof construction, said drip bend in the form of a half-cylinder externally convex having an axis parallel to said first section lower end;

a second section having ventilation openings to provide ventilation under said roof construction with a first end continuing from said first section connecting to said folding under lower end drip bend of said first section which extends below said second section and immediately extending horizontally inward under said first section;

said second section continuing into a third section having an upper end approximately perpendicular to the inner end of said second section and projecting downward for fastening to a side of a structure supporting said roof construction;

each of said first section, said second section and said third section comprises a plurality of corrugations or waves for added roof edge strength; and (d) courses of shingles attached to said roof sheathing, said first course of shingles positioned over a portion of said roof edge ventilation strip.

12. The roof construction as recited in claim 11 wherein said ventilation strip comprises aluminum.

13. The roof construction as recited in claim 11 wherein said ventilation openings comprise louvers.

14. The roof construction as recited in claim 11 wherein said first section is nailed under said first course of shingles causing said first section to straighten to become substantially flat.

15. The roof construction as recited in claim 11 wherein said corrugations or waves are slightly concave between ridges on outside surfaces of said ventilation strip.

16. A method of providing ventilation to a roof with an integral roof edge ventilation strip comprising the steps of:

extending under a first course of shingles on the roof, a first section of said ventilation strip in angular relationship to the slope of said roof, said first section lower end having a drip bend folding under approximately 180 degrees forming said roof edge, said drip bend in the form of a half-cylinder externally convex having an axis parallel to said first section lower end;

providing said ventilation under said roof with a second section of said ventilation strip having openings for air passage, with a first end continuing from said first section and connecting to said folding under lower end drip bend of said first section which extends below said second section and extending horizontally inward under said first section toward a side of a structure;

providing a third section of said ventilation strip, continuing from said second section, having an upper end approximately perpendicular to the inner end of said second section and projecting downward for fastening to said side of said structure; and providing in the material for each of said first section, said second section and said third section a plurality of corrugations or waves for added roof edge strength.

17. A method of providing ventilation to a roof with an integral roof edge ventilation strip comprising the steps of:

extending under a first course of shingles on the roof, a first section of said ventilation strip in angular relationship to the slope of said roof, said first section lower end forming said roof edge;

providing a folded under drip bend at the lower end of said first section which connects to a second section to facilitate water run-off, said drip bend in the form of a half-cylinder externally convex having an axis parallel to said first section lower end;

providing said ventilation under said roof with a second section of said ventilation strip having openings for air passage, with a first end continuing from said first section and connecting to said first section lower end which extends below said second section and said second section extending horizontally inward under said first section toward a side of a structure;

providing a third section of said ventilation strip, continuing from said second section, having an upper end approximately perpendicular to the inner end of said second section and projecting downward for fastening to said vertical side of said structure; and providing in the material for each of said first section, said second section and said third section a plurality of corrugations or waves for added roof edge strength.

18. The method as recited in claim 17 wherein said ventilation strip comprises the step of providing aluminum for said material.

19. The method as recited in claim 17 wherein said step of providing openings for air passage in said second section comprises the step of providing louvers.

20. The method as recited in claim 17 wherein said step of extending said first section under a first course of shingles comprises the stop of nailing said shingles over said first section causing said first section to straighten to become substantially flat.

* * * * *